US008833231B1

(12) United States Patent
Venema

(10) Patent No.: US 8,833,231 B1
(45) Date of Patent: Sep. 16, 2014

(54) UNMANNED RANGE-PROGRAMMABLE AIRBURST WEAPON SYSTEM FOR AUTOMATED TRACKING AND PROSECUTION OF CLOSE-IN TARGETS

(75) Inventor: Benjamin Joseph Venema, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 361 days.

(21) Appl. No.: 13/355,550

(22) Filed: Jan. 22, 2012

(51) Int. Cl.
*F41G 3/16* (2006.01)
*F41G 3/06* (2006.01)

(52) U.S. Cl.
CPC ... *F41G 3/16* (2013.01); *F41G 3/06* (2013.01)
USPC ..... 89/41.07; 89/204

(58) Field of Classification Search
CPC ..... F41G 3/06; F41G 3/065; F41G 3/16; F41G 3/165; F41G 3/147
USPC ..... 89/41.05, 41.07, 204, 205
See application file for complete search history.

(56) References Cited

U.S. PATENT DOCUMENTS

| | | | | |
|---|---|---|---|---|
| 4,386,848 | A * | 6/1983 | Clendenin et al. | 356/5.01 |
| 5,036,748 | A * | 8/1991 | Pendry | 89/36.13 |
| 5,497,704 | A * | 3/1996 | Kurschner et al. | 102/264 |
| 7,210,392 | B2 * | 5/2007 | Greene et al. | 89/41.03 |
| 2010/0010793 | A1 * | 1/2010 | Herman | 703/8 |
| 2010/0128110 | A1 | 5/2010 | Mavromatis | |
| 2012/0217301 | A1 * | 8/2012 | Namey et al. | 235/411 |

* cited by examiner

*Primary Examiner* — Stephen M Johnson
(74) *Attorney, Agent, or Firm* — Eric A. Gifford

(57) ABSTRACT

An unmanned range-programmable airburst weapon system provides automated tracking and prosecution of soft targets such as UAVs at close ranges. A range-programmable gun that fires airburst rounds and a seeker that images the target within a FOV are mounted on a gimbaled turret. A tracking controller is responsive to a target cue to point the seeker to acquire the target and to subsequent tracking commands from the seeker to maintain the target in the seeker's FOV. A fire controller is responsive to tracking commands and range-to-target measurements to compute a ballistic firing solution to range program an airburst round and to point and fire the gun so that the round explodes in mid-air at a predicted target position.

20 Claims, 7 Drawing Sheets

UNMANNED RANGE-PROGRAMMABLE AIRBURST WEAPON SYSTEM FOR AUTOMATED TRACKING AND PROSECUTION OF CLOSE-IN TARGETS

BACKGROUND OF THE INVENTION

1. Field of the Invention

This invention relates to weapon systems for prosecuting "soft" targets at close range, and more particularly to an unmanned range-programmable airburst weapon system for automated tracking and prosecution of soft targets at close ranges.

2. Description of the Related Art

Unmanned Aerial Vehicles (UAVs) or "drones" have become important assets for the U.S. military, Homeland Security and law enforcement. UAVs are stealthy, inexpensive and do not expose a pilot to enemy fire. UAVs can be used to provide reconnaissance or to provide first-strike capability on a target.

However, these same UAVs constitute a new and developing threat to U.S. military, law enforcement and civilian targets. An enemy could use a UAV to perform reconnaissance on a target or could load the UAV with explosives for a direct attack.

Existing unmanned air defense systems are configured to detect, track and defeat "hard" targets such as incoming missiles. These hard targets are fast moving, fly at traditionally high altitudes and require considerable fire power to defeat. For example, air defense systems can use a Ku-band radar to detect incoming hard targets and a Ka-band radar to track the targets with a higher resolution and provide a target cue to intercept the target at 1,000 meters or more. The air defense system then uses a weapon such as a missile, a Phalanx Close-In Weapons Systems (CIWS) with bullets or a laser to engage and defeat the target.

These unmanned air defense systems would not be effective against the threat from a "soft" target such as the UAV, nor would they be affordable. The existing Ku/Ka band radar systems would not be effective to detect and track small (e.g. <5 meters), low flying (e.g. <10 meters), relatively slow moving (e.g. <40 mph), close range (e.g. <1,000 meters) targets such as UAVs. Furthermore, the existing radar and weapon systems are far too expensive to completely deploy against a UAV threat or other "soft" targets such as manned ultralight aircraft, light boats or human targets in defilade (e.g. moving within cover).

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides an unmanned range-programmable airburst weapon system for automated tracking and prosecution of soft targets such as UAVs at close ranges.

In an embodiment, a weapon system comprises a gun and a seeker mounted on a gimbaled turret. The gun is configured to fire range-programmable airburst rounds. The seeker comprises collection optics and an IR sensor mounted for imaging the target within a field-of-view (FOV) and a tracking processor to generate tracking commands. A range finder generates range-to-target measurements. A tracking controller is responsive to a target cue to point the seeker to acquire the target and to subsequent tracking commands to maintain the target in the IR sensor's FOV. A fire controller is responsive to tracking commands and range-to-target measurements to compute a ballistic firing solution to range program an airburst round and to point and fire the gun so that the round explodes in mid-air at a predicted target position at or near the target.

In an embodiment, the weapon system comprises a target detection system including a network of one or more passive electro-optical (EO), visible or IR, sensor nodes configured to search a wide field-of-view (FOV), detect the presence of a moving target, generate the target cue and pass the cue to the gun. The target detection system may generate and prioritize target cues for multiple targets and pass the target cues to the gun in order of priority.

In different embodiments, the gun and seeker may be mounted on the seeker with a fixed or independently gimbaled pointing relationship. In the fixed pointing relationship, the tracking and fire controllers point the turret so that the target is maintained in the IR sensor's FOV and the gun is pointed at the predicted target position within the FOV of the IR sensor. In the independently gimbaled relationship, the tracking controller points the seeker optics to maintain the target in the sensor's FOV and the fire controller slews the turret to point the gun at the predicted target position outside the sensor's FOV.

In an embodiment, the seeker is multi-mode. The seeker may comprise an RF sensor that is co-boresighted and shares the collection optics. The RF sensor provides the range finder range-to-target measurements and all-weather imaging performance. The seeker may comprise a semi-active laser (SAL) sensor that is co-boresighted and shares the collection optics. The SAL sensor enables cooperative targeting by detecting laser energy reflected off of the target from a remote laser designator.

In an embodiment, the weapon system is subject to constraints on its ballistic solution and the type of airburst rounds it can fire based on defined "safety areas". The fire controller is responsive to the GPS coordinates of the gun and of the defined safety areas to inhibit firing the gun if the predicted target position (or flight path of the airburst round) is within a safety area. In some configurations, the gun may fire range-programmable rounds having different levels of lethality. The safety areas may specify which level of rounds if any that may be fired. The fire controller may be configured to select the round with the highest lethality level allowed by the safety area.

These and other features and advantages of the invention will be apparent to those skilled in the art from the following detailed description of preferred embodiments, taken together with the accompanying drawings, in which:

DETAILED DESCRIPTION OF THE INVENTION

Existing air defense systems are not well suited to provide force or structure protection against threats posed by "soft" targets such as UAVs, small boats or enemy in defilade. These "soft" targets may be characterized as small (e.g. <5 meters), low flying (e.g. <10 meters), relatively slow moving (e.g. <40 mph), close range (e.g. <1,000 meters and typically <500 meters) targets. The existing air defense systems are not designed to detect, track and prosecute these targets. Furthermore, the weapons (e.g. missiles, Galling guns or lasers) used in these systems are far too expensive to justify deploying against such soft targets and have a high risk of collateral damage.

The present invention provides an unmanned range-programmable airburst weapon system for automated tracking and prosecution of soft targets such as UAVs at close ranges. The weapon system will typically include or be deployed in conjunction with a target detection system that employs a network of sensors to detect and track the targets to provide a cue to the weapon system to initiate unmanned target tracking and prosecution. The unmanned range-programmable airburst weapon system provides a cost-effective solution to manage the threat posed by "soil" targets.

Figure 1:
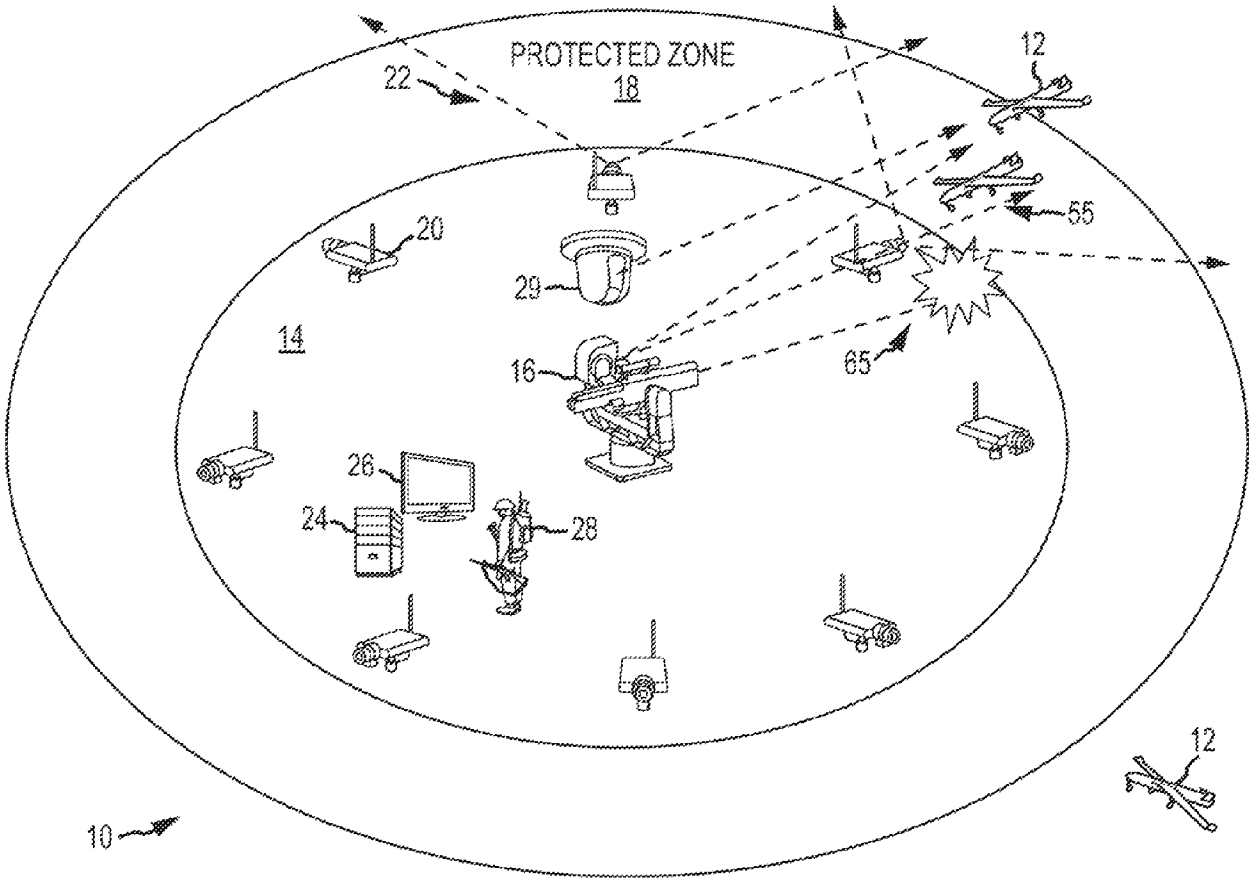
FIG. 1 is a diagram of an embodiment of a counter target weapon system including a target detection system and an unmanned range-programmable airburst weapon system for automated prosecution of close-in targets.

As shown in FIG. 1, an embodiment of a weapon system 10 for automated tracking and prosecution of close-in soft targets 12 comprises a target detection system 14 configured to search a wide area of interest, detect the presence of moving targets 12 and generate a target cue and a unmanned range-programmable airburst weapon 16 responsive to the target cue to automatically track and engage target 12. As depicted in this embodiment, weapon system 10 may use a fixed emplacement of assets (e.g. sensors and weapons) to provide perimeter protection of a defined protected zone 18. Alternately, the detection system and weapon could be deployed on a mobile platform such as a ship or ground vehicle.

Target detection system 14 suitably comprises a network of one or more sensor nodes 20 that image a wide FOV 22, suitably overlapping, to cover the wide area of interest at a close range. The sensor nodes may be emplaced to image a target with a fixed or moving FOV 22. In an embodiment, sensor nodes 20 comprise passive electro-optical (EO) sensors in either the visible or infrared (IR) spectral bands. In other embodiments, the sensor nodes 20 may operate in different spectral bands, actively or passively. The images from the network of sensor nodes 20 are provided via a communication network (wired or wireless) to a computer 24 that processes the images to detect one or more targets 12, track them and generate one or more target cues. A target cue may comprise a tracking history of the target (e.g. position and history in 2D or preferably 3D), a target identification indicating the type of target (e.g. UAV, specific type of UAV, person, small boat etc.), features of the target such as size, shape, and estimated range-to-target. The network of sensors and processing of the sensor images are configured to detect and track these types of "soft" targets. If presented with a "swarm" of multiple targets, the computer may track and prioritize multiple target cues. The computer may pass the target cues to the weapon (or weapons) one at a time as the weapon successfully prosecutes, each target.

In certain embodiments, the images may be provided on a display 26 for viewing by an observer 28. The video feeds from each sensor node 20 may be independently streamed to display 26. Alternately, the overlapping FOV of the video feeds may be fused together to provide a more complete view of the protected area. In some configurations observer 28 may be allowed or required to provide a visual confirmation of target 12 before engaging weapon 16 to prosecute the target. The weapon system may include a gimbaled identification (ID) camera 29 such as a pan-tilt-zoom (PTZ) camera responsive to the target cues to provide a higher quality image of the target for visual identification. ID camera 29 may be part of the detection system 14, may be mounted on weapon 16 or may be an integral part of the weapon's imaging capability.

A representative target detection system is described in U.S. Publication No. 2010/0128110 entitled "System and Method for Real-Time 3-D Object Tracking and Alerting Via Networked Sensors" published May 27, 2010, which is hereby incorporated by reference. The system includes two or more spatially separated 2D sensors (such as passive EO visible or IR sensors) with overlapping FOV for detecting and 3D tracking moving targets through observations. An image processor converts each sensor's observations into 2D spatial characteristics and extracts features of the different objects. A tracking processor fuses the 2D spatial characteristics and feature data from the respective sensors into 3D kinematic and feature data of the objects to provide target cues. The system uses both target kinematics (motion) and features (e.g., size, shape, color, behavior, etc.) to detect, track, display and alert users to potential objects of interest. Weapon system 10 uses the system to alert and cue unmanned range-programmable airburst weapon 16 to initiate tracking of the target.

Figure 2:
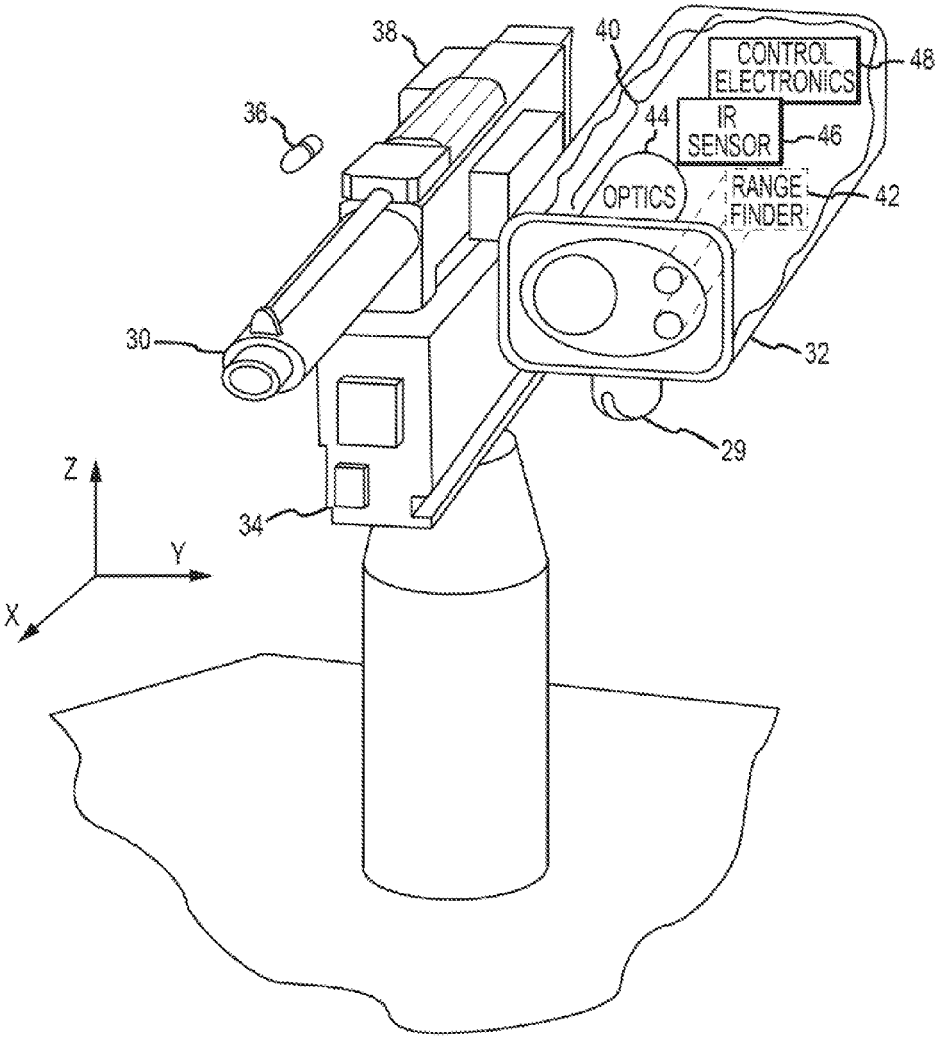
FIG. 2 is a diagram of an embodiment of an unmanned range-programmable airburst weapon system.

As shown in FIGS. 1 and 2, an embodiment of unmanned range-programmable airburst weapon 16 comprises a gun 30 and a control unit 32 mounted on a gimbaled turret 34. The weapon is "unmanned" in that a human operator is not in the loop to generate or execute the ballistic firing solution. Control unit 32 determines where to point, when to fire and at what range to detonate the round, and possibly what type of round to fire. The control unit 32 also range programs the gun/round and points and fires the gun. As mentioned previously, a human observer may be in the loop to provide target verification to enable the gun to fire. The observer does not compute or execute the ballistic firing solution.

If a fixed emplacement, turret 34 is configured to pitch and yaw about y-axis and z-axis, respectively, to point the turret. If mounted on a moving platform, turret 34 is further configured to roll about an x-axis. In this latter embodiment, weapon 16 is provided with an inertial measurement unit (IMU) to measure platform roll (and possibly yaw and pitch) and to slew the turret 34 to null out platform motion and stabilize the gun. Turret 34 includes motors to slew the turret about the axes in response to a gimbal control signal from control unit 32.

Gun 30 is configured to fire range-programmable airburst rounds 36. The gun may fire range-programmable rounds having different levels of lethality e.g. Non-Lethal (e.g. a rubber sheath), Lethal (e.g. a metal sheath), Incendiary, EMP (Electro Magnetic Pulse), armor piercing, anti-personnel, door breaching etc. from a munitions feed 38. These rounds may be "low-velocity" (e.g. <400 m/s) or "high-velocity (e.g. >400 m/s). The gun is responsive to a range-to-target command from control unit 32 to range program airburst round 36 to explode at a specified detonation distance. In one version the airburst round tracks its distance traveled by the number of rotations after it is fired, and detonates at the programmed distance. In an embodiment, the gun places an amount of charge on a capacitor in the round based on range, the capacitor charge is reduced with each revolution until hits a threshold and detonates the round. For example, an XM-25 Counter Defilade Target Engagement (CDTE) system is one instance of a semiautomatic air burst gun that fires range programmable-airburst rounds. The XM-25 is modified to be responsive to the range-to-target command from control unit 32 rather than a manual adjustment of the detonation distance and a fire command rather than manual firing.

Control unit 32 comprises a seeker 40 for imaging the target within a field-of-view (FOV) to generate tracking commands and a range finder 42 for generating range-to-target measurements. Seeker 40 comprises collection optics 44 and an IR sensor 46 mounted for imaging the target and a tracking processor (included in control electronics 48) to generate tracking commands. Seeker 40 may be "multi-mode" including one or both of an RF transmitter/receiver and a SAL sensor that are co-boresighted and share collection optics 44. The RF transmitter/receiver provides the range finder range-to-target measurements and all-weather imaging performance. The SAL sensor enables cooperative targeting by detecting laser energy reflected off of the target from a remote laser designator.

Control electronics 48 include a tracking controller responsive to a target cue (e.g. from target detection system 14) to point the seeker to acquire the target and to subsequent tracking commands from the tracking processor to maintain the target in the IR sensor's FOV. Control electronics 48 include a fire controller responsive to tracking commands and range-to-target measurements to compute a ballistic firing solution to generate the range-to-target command to range program an airburst round and to point and fire the gun so that the round explodes in mid-air at a predicted target position. Note, in many cases the detonation distance specified by the range-to-target command will differ from the range-to-target measurement on account of target, and possibly platform, motion and the velocity of the airburst round. In different embodiments shown in FIGS. 4*a* and 4*b*, the seeker and gun have an offset and fixed pointing relationship or an independently gimbaled pointing relationship to track the target and fire the round. In the former, the electronics generate a single gimbal control signal to point the turret to both track the target and fire the gun. In the later, the electronics generates a gimbal control signal to point the turret to point and fire the gun and a tracking command signal to point the seeker to track the target.

In an embodiment, control unit 32 may comprise the PZT ID camera 29 for generating the video signal for display for human target verification to comply with visual rules of engagement. Camera 29 may be fixed or independently gimbaled on turret 34. Camera 29 may function independently of the seeker (as shown) or may be incorporated within the seeker and share the collection optics. Furthermore, the IR sensor may serve as the ID camera in which case the IR imagery is processed so that it is suitable for display and visual verification.

Figure 3:
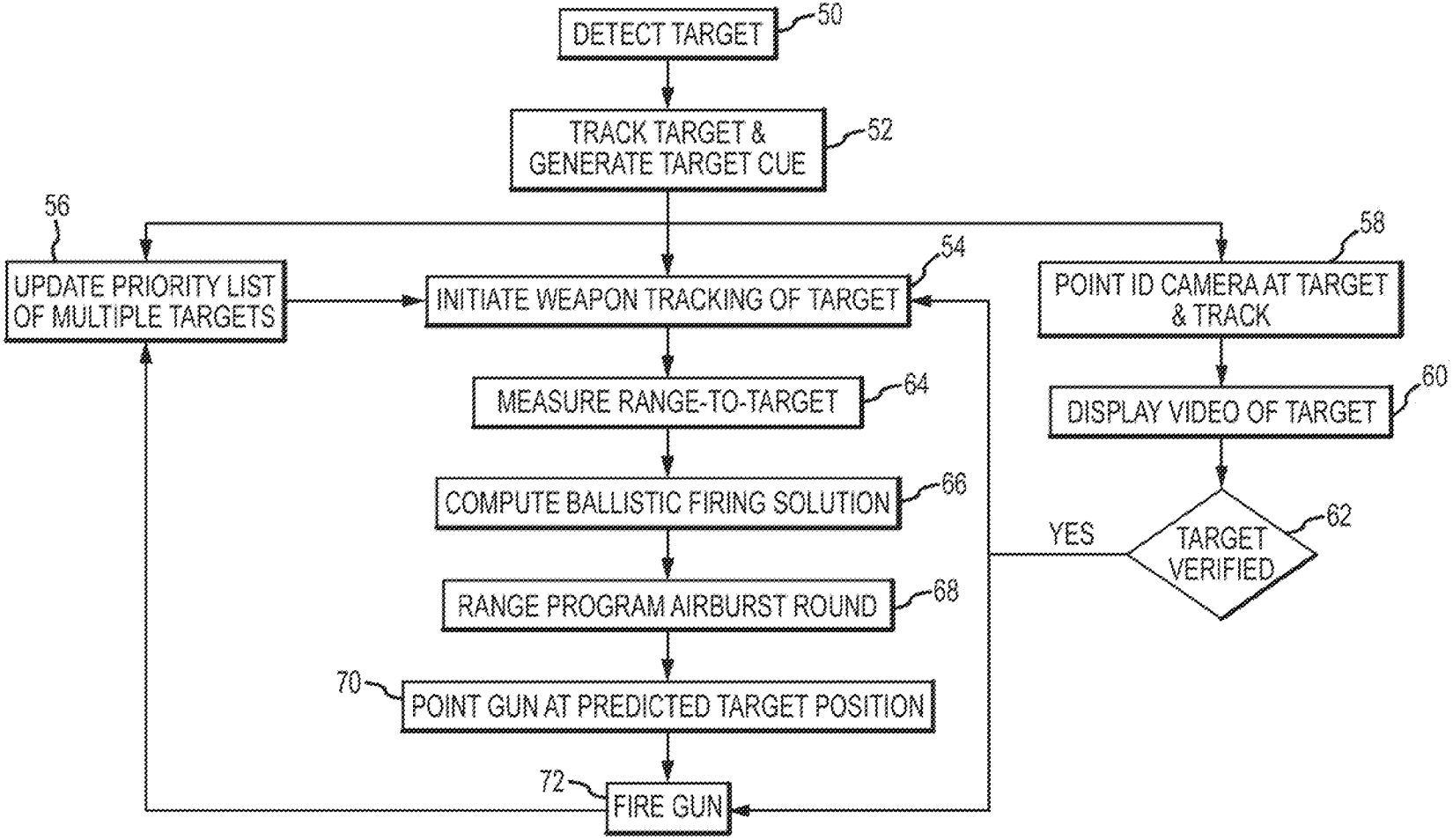
FIG. 3 is a flow diagram of an embodiment of the weapon system to detect, track and engage the target.

Referring now to FIGS. 1 through 3, target detection system 14 detects a target (step 50) and tracks the target to generate a target cue (step 52). Target detection system 14 may pass the target cue directly to weapon system 16 to initiate weapon tracking of the target (step 54). The seeker acquires the target in response to the target cue and generates tracking commands to maintain the target within its narrow FOV 55. Alternately, the target detection system 14 may update and prioritize a list of multiple target cues (step 56) if subjected to a "swarm" of targets and pass the highest priority target cue to weapon system 16. The target cue may be used to point the ID camera at the target (step 58) to provide the video display (step 60) for visual target confirmation (step 62). If not verified, the target cue may be removed or followed until positive target confirmation can be made. A positive verification may be used to either allow the weapon to initiate tracking and fire when ready or to fire.

Once the weapon system has acquired the target and initiated tracking, it measures, and periodically or continuously updates, a range-to-target to measurement (step 64). The weapon system processes the tracking commands and range-to-target measurements to compute a ballistic firing solution 65 e.g. where to point, when to fire, and detonation range (step 66). The system may receive and process other relevant information such as the type of target to compute the ballistic firing solution. The firing solution may also specify the type of airburst round e.g. lethal, non-lethal, incendiary etc. that is best suited (or maximum lethality allowed) to prosecute the target. To execute the firing solution, the weapon system selects and range programs an airburst round (step 68), points the gun at the predicted target position (step 70) and fires the gun at the specified time (step 72). The weapon system may send a message back to the target detection system to acknowledge that a round was fired at the target. The target detection system and/or weapon seeker may employ imaging techniques to assess whether the target was destroyed. These techniques may be fully automated or augmented by observation of the video from the ID camera. This information can be used to update the priority list and the sequence of target cues sent to the weapon system.

Figure 4A:
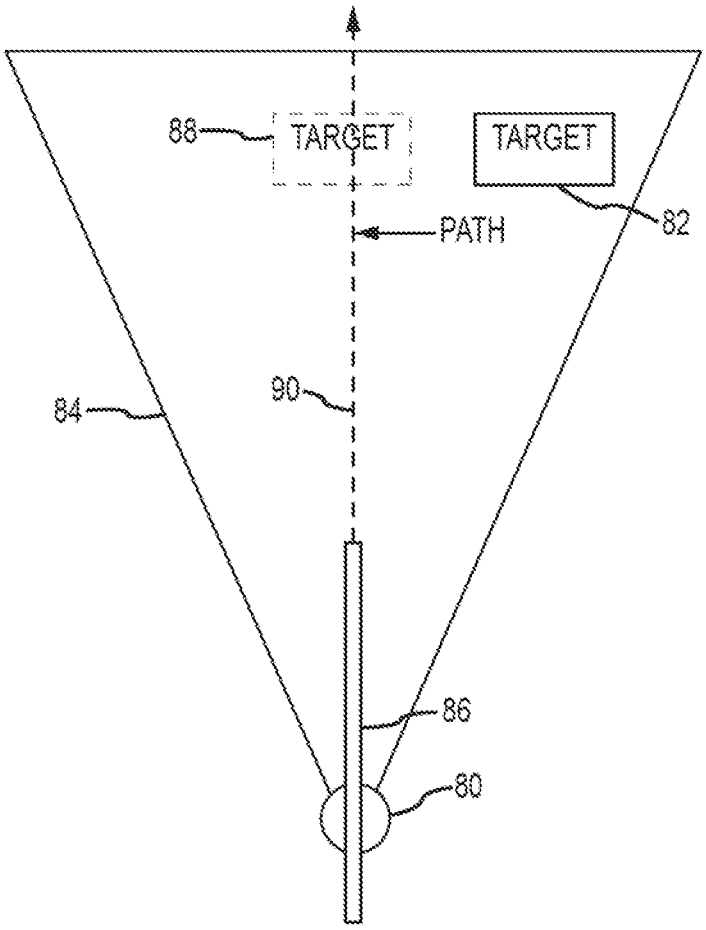
FIGS. 4*a* and 4*b* are diagrams of fixed and independently gimbaled seekers, respectively, for tracking the target.
Figure 4B:
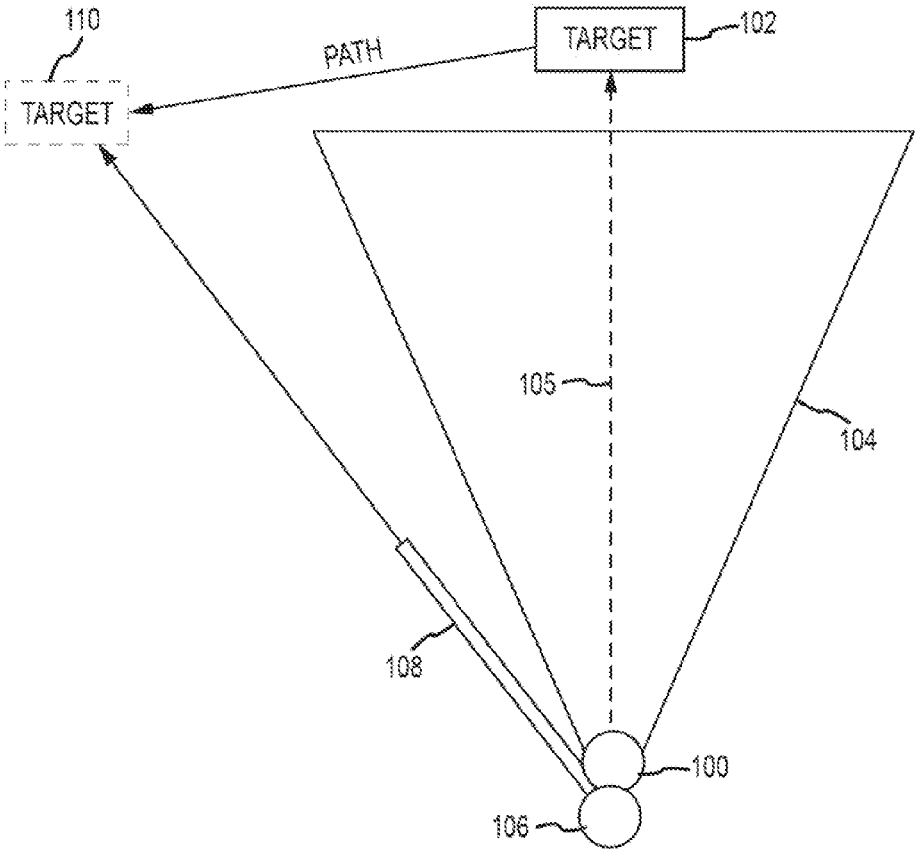

In different embodiments shown in FIGS. 4*a* and 4*b*, the seeker and gun have an offset and fixed pointing relationship or an independently gimbaled pointing relationship to track the target and fire the round. In the former, the electronics generate a single gimbal control signal to point the turret to both track the target and fire the gun. In the later, the electronics generates a turret gimbal control signal to point the turret to point and fire the gun and a seeker gimbal command signal to point the seeker to track the target.

As shown in FIG. 4*a*, in the fixed pointing relationship, the tracking and fire controllers point a turret 80 so that a target 82 is maintained in the IR sensor's FOV 84 and a gun 86 is pointed at a predicted target position 88 within the FOV 84 of the IR sensor. In an embodiment, the tracking controller and fire controller point the turret so that the gun points along a central axis 90 of the IR sensor's FOV at the predicted target position 88 and the target is imaged off-axis within the sensor's FOV 84. For example, if the sensor's FOV is 6 degrees, the target may be imaged 1.5 to 2.5 degrees off-axis, for example. This fixed pointing relationship is useful when the range-programmable airburst round is fired at a high velocity in excess of 400 m/s.

As shown in FIG. 4*b*, in the independently gimbaled relationship, the tracking controller points the gimbaled seeker collection optics 100 to maintain a target 102 in the sensor's FOV 104, suitably along a central axis 105 of the sensor's FOV, and the fire controller stews the turret 106 to point the gun 108 at the predicted target position 110 outside the sensor's FOV. This independently gimbaled pointing relationship is useful when the range-programmable airburst round is fired at a low velocity less than 400 m/s.

Figure 5:
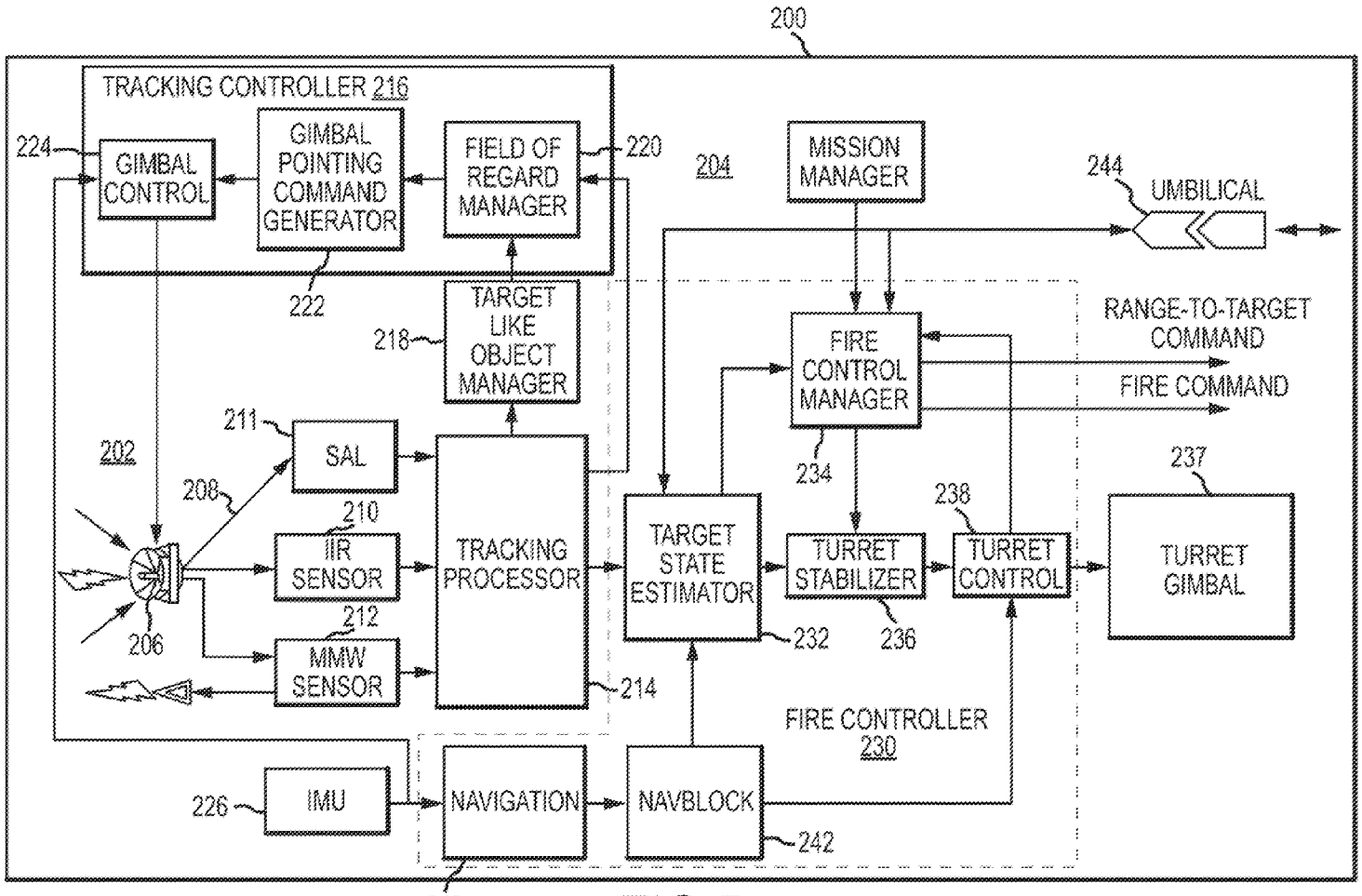
FIG. 5 is a block diagram of an embodiment of a control unit comprising a multi-mode seeker.

An embodiment of a control unit 200 including an independently gimbaled multi-mode seeker 202 and control electronics 204 is illustrated in FIG. 5. Seeker 202 includes collection optics 206 mounted on a two-axis gimbal 208 that collects electro-magnetic energy for an IR sensor 210, a SAL sensor 211 and an RF transmitter/receiver 212. Images from one or more of the sensors are passed to a tracking processor 214 that uses the initial target cue, target kinematics (motion) and features (e.g., size, shape, color, behavior, etc.) to acquire and then track the target to generate the tracking commands and range-to-target measurements (via the RF transmitter/receiver).

The tracking commands are passed to a tracking controller 216 that generates a seeker gimbal control signal to slew gimbal 208 to point collection optics 206 to maintain the target within the FOV. In this embodiment, tracking controller 216 comprises a target like object manager 218 that creates a target prioritization list based on predicted threat, ballistic solution, and determines optimal round types and order of firing, a field of regard manager 220 that keeps the sensor and gun in the field of view, a gimbal pointing command generator 222 that generates the seeker gimbal control signal and a gimbal control 224 that (if applicable) adjusts the gimbal control signal to compensate for inertial measurements for platform motion from an IMU 226 and actuates the two-axis gimbal 208 to point collection optics 206.

The tracking commands and range-to-target measurements are also passed to a fire controller 230 that compute a ballistic firing solution including a turret gimbal command signal to point the gun at a predicted target position, a range-to-target command to program the detonation distance of the airburst round at the predicted target position and a fire command to fire the gun so that the round explodes in mid-air at the predicted target position at the correct time. The ballistic firing solution may also include a command to select the type of round.

In this embodiment, fire controller 230 comprises a target state estimator 232 that processes the tracking commands to creates a target prioritization list based on predicted threat, ballistic solution, and determines optimal round types and order of firing, a fire control manager 234 that keeps the sensor and gun in the field of view, a turret stabilizer 236 that adjusts the turret for platform movement and a turret control 238 that generates the turret gimbal control signal to actuate a turret gimbal 237 to point the gun at the predicted target position. Fire control manager 234 receives target threat analysis and GPS safe area inputs from a mission manager 239 that determines which round to fire Target state estimator 232 (and turret control 238) may also receive navigation inputs for the platform via IMU 226 and navigation 240 and NavBlock 242 that adjusts the turret to compensate for platform motion. Target state estimator 232 (and fire control manager 234) may also receive other sensor inputs such as temperature, humidity, wind etc. from sensors on the platform via an umbilical connection 244.

Figure 6:
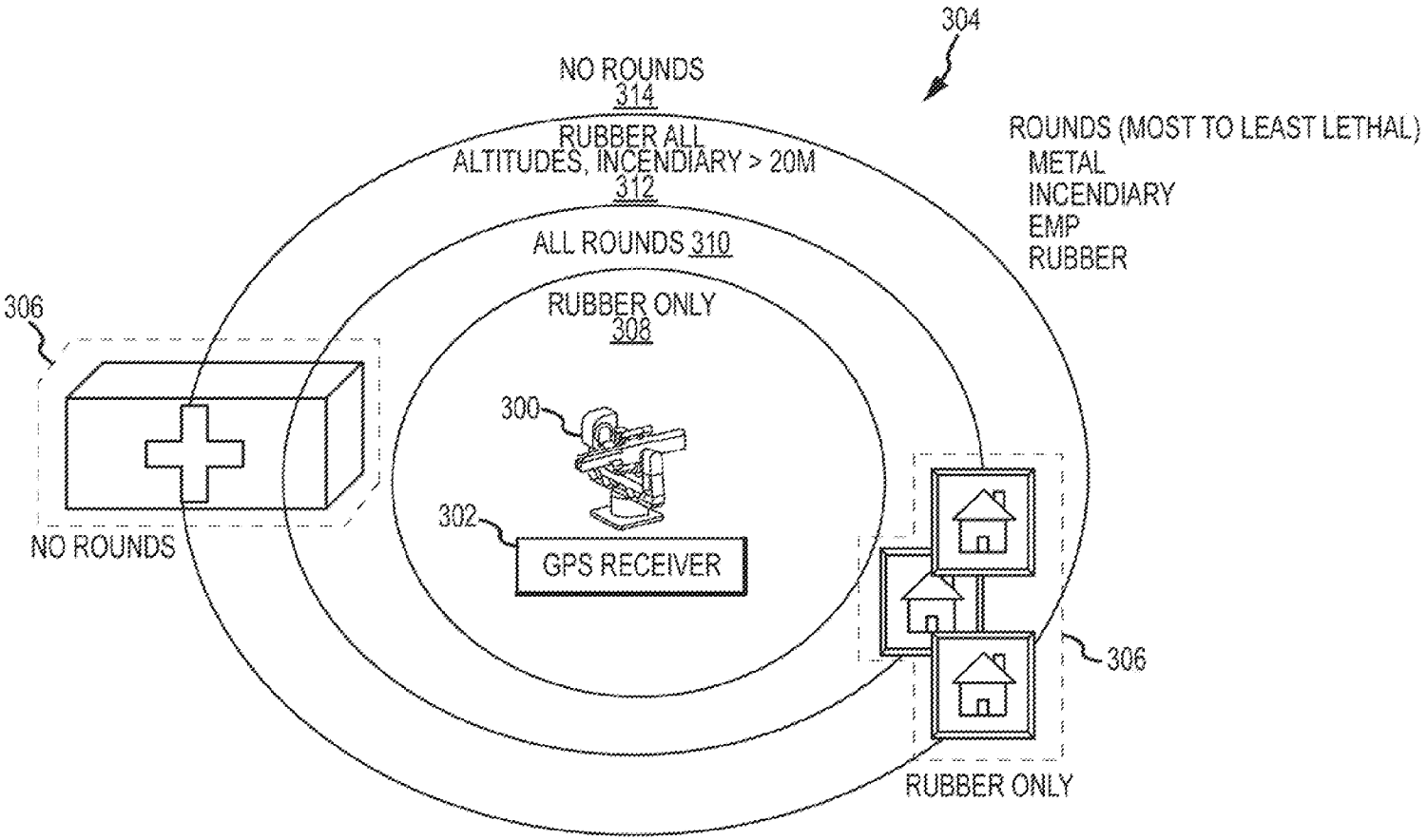
FIG. 6 is a diagram illustrating an embodiment of airburst round selection based on the ballistic firing solution and defined safe areas.

An embodiment of a weapon system 300 is illustrated in FIG. 6 in which the use and lethality of airburst rounds is constrained by the definition of "safe areas". Weapon system 300 is provided with its GPS coordinates, suitably by mounting a GPS receiver 302 on the weapon system 300. Various types of safe areas may be defined based either on the location relative to the weapon itself e.g. "perimeter safe areas" 304 or on the nature of the safe area e.g. "subject safe areas" 306 and its absolute coordinates such as churches, hospitals, EMP sensitive areas, civilian housing etc. The definition of the safe areas may be binary i.e. fire or no fire or may be graded e.g. specifying the types of rounds or maximum lethality round that may be used. The engagement protocol may rank the rounds in order of lethality from most lethal to the least lethal.

In this example, four different perimeter safe areas are defined. In perimeter safe area 1 308, representing the area closest to the weapon, only rubber rounds are allowed. In perimeter safe area 2 310, all rounds are allowed. In perimeter safe area 3 312, rubber rounds are allowed at all altitudes and incendiary rounds are allowed at altitudes above 20 meters. In perimeter safe area 4 314, representing all areas outside a maximum distance, no rounds are allowed. Two subject safe areas 306 are defined around a housing complex in which the maximum allowed round is rubber regardless of the distance and a hospital in which no rounds may be fired.

The weapon system is configured with these perimeter and subject safe areas. When the weapon system computes a ballistic firing solution, the system checks the predicted target position against the safe areas to determine whether it can fire and, if so, what types of rounds are available. The system may also check the entire flight path of the round to determine if the round is passing through any safety areas. Depending upon the engagement protocol, the flight path may or may not restrict the available rounds. If a protected area is subject to attack from a "swarm" of targets such as UAVs, the weapon system may override, in part or in whole, the constraints placed on the system by the safety areas in order to engage the swarm.

In an alternate embodiment, "safe areas" may be programmed into a manned or unmanned range-programmable airburst gun to constrain the use and lethality of the airburst rounds. The ballistic firing solution may be provided by an automated fire controller as previously described or may be provided manually by aiming the gun and entering the detonation distance. The gun may be provided with an IMU or other sensors to determine where it is pointing. The gun compares the predicted target position to the defined safe areas to select the appropriate round, which may be the maximum lethality round allowed by the safe area.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A weapon system for automated tracking and prosecution of close-in non-projectile targets, comprising:

a gimbaled turret configured to pitch and yaw to point the turret;

a gun mounted on the turret, said gun configured to fire range-programmable airburst rounds to prosecute close-in non-projectile targets to provide perimeter protection for a protected zone;

a feed for said range-programmable airburst rounds; and a control unit mounted on the turret, said control unit comprising:

a seeker comprising collection optics and an IR sensor mounted for imaging the non-projectile target within a field-of-view (FOV) and a tracking processor to generate tracking commands;

a range finder for generating range-to-target measurements;

a tracking controller responsive to a target cue to point the seeker to acquire the target and to subsequent tracking commands to maintain the target in the IR sensor's FOV; and a fire controller responsive to tracking commands and range-to-target measurements to compute a ballistic firing solution including a direction to point at a predicted target position, a time to fire and a detonation range for an airburst round and execute the fire solution by selecting and range programming an airburst round with said detonation range and pointing and firing the gun in the direction at the time to fire so that the round explodes in mid-air at the predicted target position.

2. The weapon system of claim 1, wherein the gun and the seeker collection optics are mounted on the turret with a fixed pointing relationship, said tracking controller and fire controller responsive to tracking commands to point the turret so that the target is maintained in the IR sensor's FOV and the gun points at the predicted target position within the FOV of the IR sensor, wherein the direction to the target is offset from the pointing direction of the gun at the predicted target position.

3. The weapon system of claim 2, wherein said tracking controller and said fire controller point the turret so that the gun points along a central axis of the IR sensor's FOV at the predicted target position and the target is imaged off-axis within the sensor's FOV.

4. The weapon system of claim 2, wherein the range-programmable airburst round is fired at a velocity in excess of 400 m/s.

5. The weapon system of claim 1, wherein the turret is mounted on a moving platform, said gimbaled turret configured to pitch, yaw and roll to point the turret, further comprising an inertial measurement unit (IMU) to provide inertial measurements including a platform roll measurement, said tracking controller and fire controller responsive to the inertial measurements to maintain the target in the sensor FOV and to point the gun at the predicted target position.

6. The weapon system of claim 1, further comprising:

a gimbaled target identification camera responsive to the target cue or tracking commands to track the target to acquire and display an image for human visual target confirmation to enable the gun to fire.

7. The weapon system of claim 1, further comprising:

a target detection system comprising a network of one or more sensor nodes configured to search a wide field-of-view (FOV), detect the presence of a moving target and generate the target cue.

8. The weapon system of claim 7, wherein the target detection system generates and prioritizes target cues for a plurality of targets, said system providing the target cues to the gun in order of priority.

9. The weapon system of claim 1, wherein the feed includes range-programmable airburst rounds having different levels of lethality, said fire controller selecting the lethality of the airburst round fired at the target based on the detonation range in the ballistic firing solution.

10. The weapon system of claim 1, wherein said tracking controller and said fire controller are responsive to tracking commands to point the turret to that a direction to the target maintained in the IR sensor's FOV is offset from a pointing direction of the gun at the predicted target position.

11. A weapon system for automated tracking and prosecution of close-in targets, comprising:

a gimbaled turret configured to pitch and yaw to point the turret;

a gun mounted on the turret, said gun configured to fire range-programmable airburst rounds; and a control unit mounted on the turret, said control unit comprising:

a seeker comprising collection optics and an IR sensor mounted for imaging the target within a field-of-view (FOV) and a tracking processor to generate tracking commands, wherein the seeker collection optics are gimbal-mounted within the control unit to point independently of the turret;

a range finder for generating range-to-target measurements;

a tracking controller responsive to a target cue to point the seeker to acquire the target and to subsequent tracking commands to point the seeker optics to maintain the target in the IR sensor's FOV; and a fire controller responsive to tracking commands and range-to-target measurements to compute a ballistic firing solution for an airburst round, to slew the turret to point the gun at the predicted target position outside the FOV of the IR sensor and fire the gun so that the round explodes in mid-air at a predicted target position.

12. The weapon system of claim 11, wherein the range-programmable airburst round is fired at a velocity less than 400 m/s.

13. A weapon system for automated tracking and prosecution of close-in targets, comprising:

a gimbaled turret configured to pitch and yaw to point the turret;

a gun mounted on the turret, said gun configured to fire range-programmable airburst rounds; and a control unit mounted on the turret, said control unit comprising:

a seeker comprising collection optics that collects both IR and RF radiation from the target, co-boresighted IR and RF sensors mounted for imaging the target within a field-of-view (FOV) and a tracking processor to generate tracking commands, said RF sensor generating both images of the target and range-to-target measurements;

a tracking controller responsive to a target cue to point the seeker to acquire the target and to subsequent tracking commands to maintain the target in the IR sensor's FOV; and a fire controller responsive to tracking commands and range-to-target measurements to compute a ballistic firing solution for an airburst round including to point and fire the gun so that the round explodes in mid-air at a predicted target position.

14. The weapon system of claim 13, wherein the seeker further comprises a semi-active laser (SAL) sensor that detects laser energy reflected off the target, said SAL sensor co-boresighted with the IR and RF sensors to share the optics to collect laser energy.

15. A weapon system for automated tracking and prosecution of close-in targets, comprising:

a gimbaled turret configured to pitch and yaw to point the turret;

a gun mounted on the turret, said gun configured to fire range-programmable airburst rounds; and a control unit mounted on the turret, said control unit comprising:

a seeker comprising collection optics and an IR sensor mounted for imaging the target within a field-of-view (FOV) and a tracking processor to generate tracking commands;

a range finder for generating range-to-target measurements;

a tracking controller responsive to a target cue to point the seeker to acquire the target and to subsequent tracking commands to maintain the target in the IR sensor's FOV; and a fire controller responsive to tracking commands and range-to-target measurements to compute a ballistic firing solution for an airburst round including to point and fire the gun so that the round explodes in mid-air at a predicted target position, wherein the fire controller is responsive to GPS coordinates of the gun and GPS coordinates of safety areas to inhibit firing the gun if the predicted target position is within a safety area.

16. The weapon system of claim 15, wherein the gun is configured to fire different range-programmable rounds having different levels of lethality, said safety areas specifying the rounds if any that may be fired, said fire controller selecting the round with the highest lethality level allowed by the safety area.

17. A weapon system for automated tracking and prosecution of close-in non-projectile targets, comprising:

a fixed emplacement target detection system comprising a network of one or more visible or IR sensor nodes positioned within a defined protected zone, said nodes configured to search a wide field-of-view (FOV), detect the presence of a moving non-projectile target and generate a target cue; and a fixed emplacement weapon within the defined protected zone, comprising:

a gimbaled turret configured to pitch and yaw to point the turret;

a gun mounted on the turret, said gun configured to fire range-programmable airburst rounds;

a feed for said range-programmable airburst rounds; and a control unit mounted on the turret, said control unit comprising:

a seeker comprising collection optics and an IR sensor for imaging the target within a narrow FOV and a tracking process to generate tracking commands;

a range finder for generating range-to-target measurements;

a tracking controller responsive to the target cue to point the seeker to acquire the target and to subsequent tracking commands to maintain the target in the IR sensor's narrow FOV; and a fire controller responsive to coordinates of the fixed emplacement unmanned weapon and coordinates that define the protected zone and to tracking commands and range-to-target measurements to compute a ballistic firing solution to range program an airburst round and to point and fire the gun so that the round explodes in mid-air at a predicted target position to provide perimeter protection of the defined protected zone.

18. The weapon system of claim 17, wherein the sensor collection optics are gimbal-mounted within the control unit to point independently of the turret, said tracking controller responsive to tracking commands to point the seeker collection optics to maintain the target in the IR sensor's FOV, said fire controller responsive to tracking commands and range-to-target measurements to slew the turret to point the gun at the predicted target position outside the FOV of the IR sensor.

19. The weapon system of claim 17, wherein the seeker further comprises an RF sensor that both images the target and provides the range finder range-to-target measurements, said IR and RF sensors being co-boresighted and sharing the collection optics to collect IR and RF radiation from the target.

20. The weapon system of claim 17, wherein the gun is configured to fire different range-programmable rounds having different levels of lethality, said fire controller responsive to GPS coordinates of the gun and GPS coordinates of safety areas specifying the rounds if any that may be fired, said fire controller selecting the round with the highest lethality level allowed by the safety area.

* * * * *